US005350325A

United States Patent [19]

Nanami

[11] Patent Number: 5,350,325

[45] Date of Patent: Sep. 27, 1994

[54] WATER INJECTION PROPULSION DEVICE

[75] Inventor: Masayoshi Nanami, Hamamatsu, Japan

[73] Assignee: Sanshin Kogyo Kabushiki Kaisha, Hamamatsu, Japan

[21] Appl. No.: 69,977

[22] Filed: May 28, 1993

[30] Foreign Application Priority Data

Jun. 17, 1992 [JP] Japan ..... 4-181518

[51] Int. Cl.[5] ..... B63H 11/02

[52] U.S. Cl. ..... 440/41; 440/43

[58] Field of Search ..... 440/38, 40, 41, 42, 440/43, 44, 47; 60/220, 221, 222

[56] References Cited

U.S. PATENT DOCUMENTS 3,146,586 9/1964 Newby ..... 440/41
3,347,203 10/1967 Starry ..... 440/41
4,176,616 12/1979 Robins ..... 440/47
4,992,065 2/1991 Torneman et al. ..... 440/41
5,062,815 11/1991 Kobayashi ..... 440/86
5,199,913 4/1993 Toyohara et al. ..... 440/47

FOREIGN PATENT DOCUMENTS 3-19797 3/1991 Japan .

*Primary Examiner*—Stephen P. Avila
*Attorney, Agent, or Firm*—Knobbe, Martens, Olson & Bear

[57] ABSTRACT

A jet propelled watercraft having a reverse thrust mechanism including a reverse thrust bucket. The hull is provided with a portion that underlies the discharge nozzle of the jet propulsion unit and which provides a continuous surface for the hull when the reverse thrust bucket is in the forward drive mode. However, when the reverse thrust bucket is moved to the reverse thrust position, a closure panel opens to provide an opening through which water may be discharged during reverse thrust operation.

13 Claims, 3 Drawing Sheets

WATER INJECTION PROPULSION DEVICE

BACKGROUND OF THE INVENTION

This invention relates to a water injection propulsion device and more particularly to an improved reverse thrust arrangement for such a device.

The use of water jet propulsion devices for watercraft are gaining wide acceptance. Such units have a number of advantages over more conventional propulsion type devices. However, there are times it is desirable to operate the watercraft in a reverse thrust direction and reverse operation must be achieved in a slightly different manner than with conventional propeller type devices.

That is, it is the normal practice to provide a reverse thrust bucket which cooperates with the discharge of the jet propulsion unit for redirecting the water flow in a forward direction so as to effect a reverse driving thrust. A wide variety of devices have been proposed for this purpose.

However, frequently is it the practice to mount the jet propulsion unit in a tunnel beneath the hull of the watercraft. It is desirable, so as to improve the speed of the hull, to extend the hull in the area beneath the discharge nozzle of the jet propulsion unit. When this is done, however, then the extending hull portion will interfere with the water flow under reverse mode and give rise to certain problems.

It is, therefore, a principal object to this invention to provide an improved reverse thrust arrangement for a jet propelled watercraft.

It is a further object to this invention to provide a jet propelled watercraft wherein the hull has a portion that extends beneath the discharge nozzle so as to improve hull efficiency but wherein reverse thrust operation is accomplished without interference from the hull of the watercraft.

It is a further object to this invention to provide an improved arrangement for actuating a reverse thrust bucket and a portion of the hull which accommodates the water flow when operating in reverse mode.

SUMMARY OF THE INVENTION

This invention is adapted to be embodied in a watercraft having a hull supporting a jet propulsion unit for propulsion of the hull. The jet propulsion unit has a discharge nozzle and the hull has a portion that extends beneath the discharge nozzle. A reverse thrust bucket is movably supported relative to the discharge nozzle for movement between a forward drive position in which a forward driving thrust is accomplished and a reverse driving position wherein a reverse thrust is generated through deflection of the water from the discharge nozzle to the underlying hull area. A moveable panel is provided in the underlying hull area which is moved to an opened position when operating in reverse thrust mode so as to permit unencumbered discharge of the redirected water when operating in this mode.

DETAILED DESCRIPTION OF THE PREFERRED EMBODIMENTS OF THE INVENTION

Figure 1:
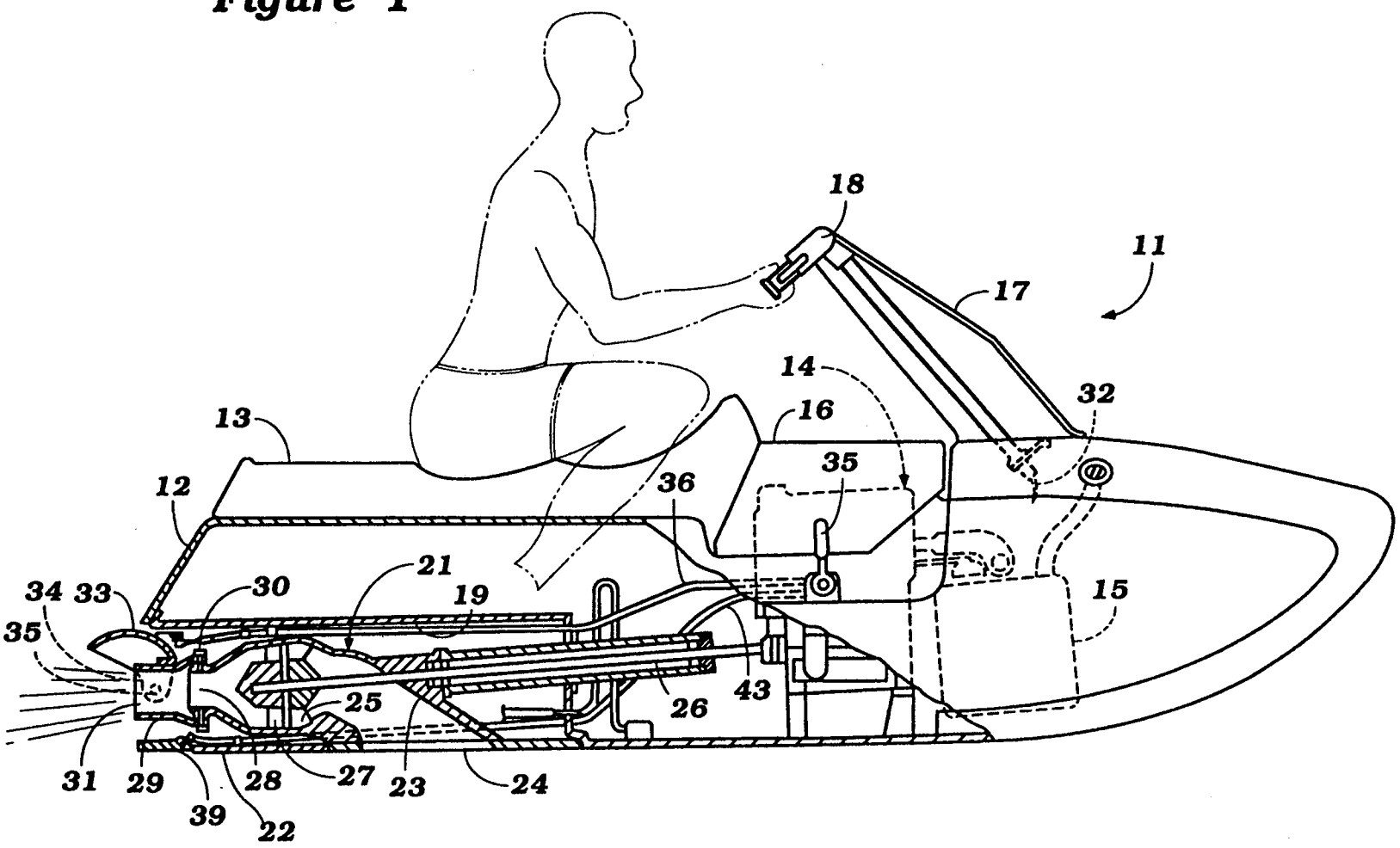
FIG. 1 is a side elevational view of small watercraft constructed in accordance with an embodiment of the invention, with a portion broken away and components shown in a forward drive condition.
Figure 2:
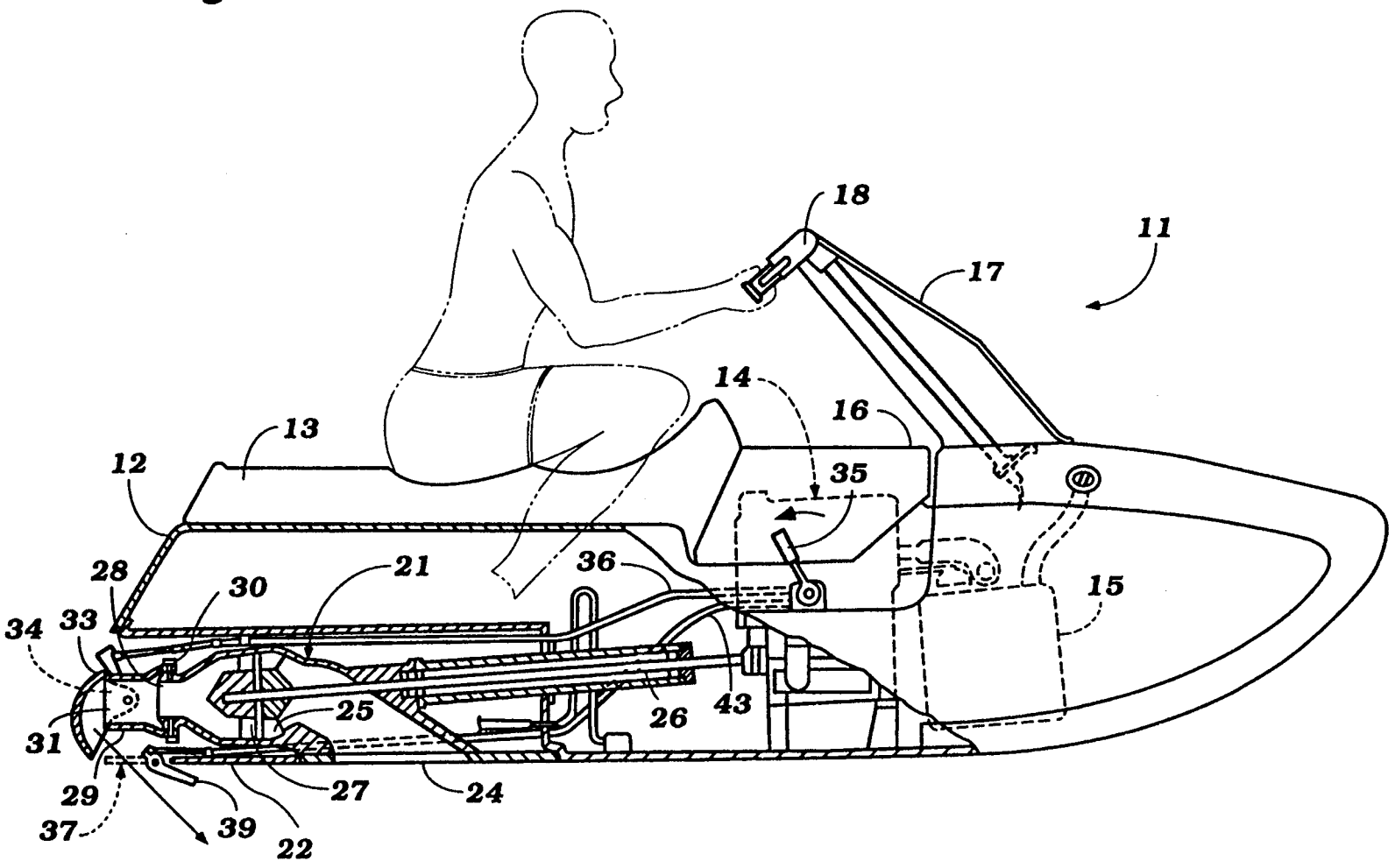
FIG. 2 is a view in part similar to FIG. 1, and shows the device operating in a reverse thrust mode.

Referring in detail to the drawings and initially to FIGS. 1 and 2, a small watercraft constructed in accordance with an embodiment of the invention is identified generally by the reference numeral 11. The small watercraft 11 is depicted as being of the type that is designed to be operated by a single rider or a pair of riders seated in tandem, straddle fashion. It is to be understood, however, that the invention can be utilized in conjunction with a wide variety of types of watercraft but has particular utility in conjunction with those watercraft powered by jet propulsion units.

The watercraft 11 is comprised of a hull 12 which is formed from a suitable material such as a molded fiberglass reinforced resin or the like. The hull 12 provides a rider's area in which a seat 13 is positioned so as to accommodate one or more riders seated in tandem, straddle fashion, and a pair of depressed foot areas are provided on the opposite sides of the seat 13.

An engine compartment is formed in the hull 12 forwardly of the seat 13 and it contains an internal combustion engine, indicated generally by the reference numeral 14 which may be of any known type. For example, the engine 14 may be of a two or three cylinder in-line type operating on a two cycle, crankcase compression principal. Of course, various other types of prime movers may be employed for powering the watercraft 11.

A fuel tank 15 is positioned in the engine compartment forwardly of the engine 14 and supplies fuel to the engine for its operation in a well known manner.

A removable hatch cover 16 is provided forwardly of the seat 13 and above the engine 14 so as to permit servicing of the engine 14.

A mast 17 is mounted on the hull 12 forwardly of the hatch cover 16 and carries a handle bar assembly 18 for control of the speed of the engine 14 and the steering of the watercraft 11, in a manner which will be described.

A tunnel 19 is formed centrally on the lower side of the hull 12 beneath the rear portion of the seat 13. A jet propulsion unit, indicated generally by the reference numeral 21 is positioned within the tunnel 19 for propelling the watercraft. The jet propulsion unit 21 is supported by means including a closure plate 22 that is affixed to the underside of the hull 12 is a suitable manner and which, except as hereinafter will be noted, closes the tunnel 19 so as to provide a continuing lower surface for the hull so as to improve hull performance.

The jet propulsion unit 21 includes a water inlet portion 23 having a downwardly facing water inlet opening which cooperates with a water inlet opening 24 formed in the closure plate 22 so as to permit water to be drawn into the jet propulsion unit 21.

An impeller 25 is affixed to an impeller shaft 26 which is driven by the output shaft of the engine 14 in a known manner. The impeller 25 draws water through the inlet opening 24 and water inlet passage 23 and drives it rearwardly across a set of straightening vanes 27. The straightening vanes 27 lead the water to a discharge nozzle portion 28 positioned at the rear of the jet propulsion unit 21 and above the closure plate 22.

A steering nozzle 29 is pivotally supported at the rear end of the discharge nozzle 28 on vertically extending pivot pins 30 for directing the flow of water from the discharge nozzle 28 through a steering nozzle discharge 31. A bowden wire cable 32 interconnects the steering nozzle 29 with the handle bar 18 for steering of the watercraft in a well known manner.

Figure 3:
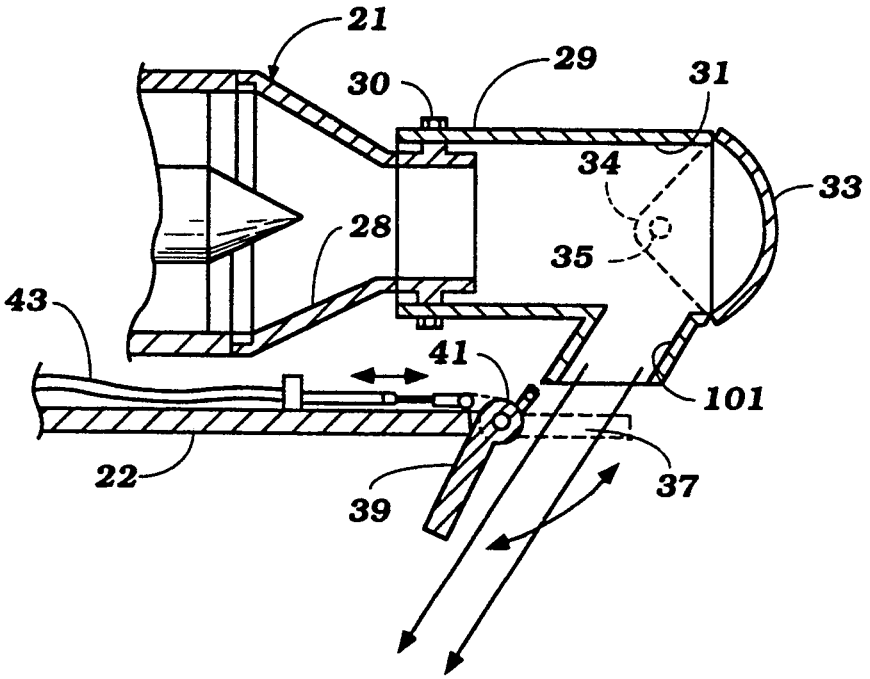
FIG. 3 is an enlarged cross sectional view showing the discharge nozzle portion of the jet propulsion unit of another embodiment and the underlying hull, when operating in a reverse thrust mode.

A reverse thrust bucket 33 has a pair of lugs 34 that are disposed on opposite sides of the steering nozzle 29 and is pivotally supported thereon by means of a pair of pivot pins 35 for movement between a forward thrust position as shown in FIG. 1 and a reverse thrust position as shown in FIGS. 2 and 3. This reverse thrust bucket 33 is operated by a shift lever 35 that is pivotally supported on the hull 12 in an area easily accessed by a rider seated on the seat 13 and preferably in an area below and to one side of the mast 17. A bowden wire actuator 36 interconnects the shift lever 35 with the reverse thrust bucket 33 for moving it between its positions in a well known manner.

In order to improve hull performance, it is desirable that the closure plate 22 extend below the steering nozzle 29. As should be readily apparent, however, if this is done then the water flow will be obstructed when the reverse thrust bucket 33 is in its reverse thrust position. In order to permit the use of maximum hull efficiency without providing such a flow restriction. The closure plate 22 is provided with a cut-out portion 37 which is aligned with the area where the reverse thrust bucket 33 diverts the water when the reverse thrust bucket 33 is in its reverse position.

Figure 4:
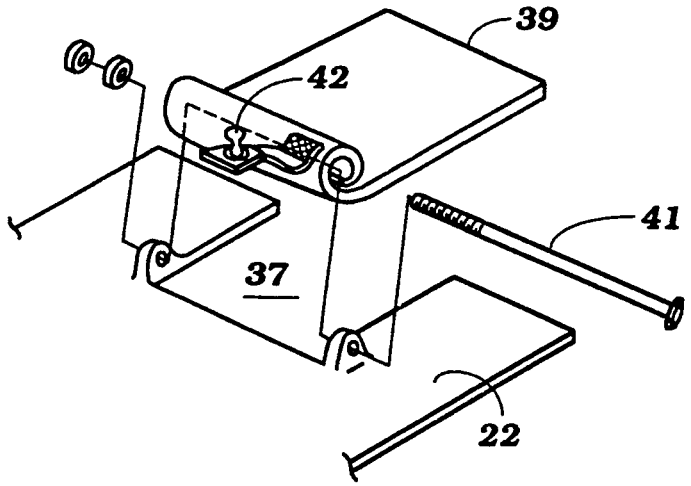
FIG. 4 is an exploded perspective view showing the construction of the moveable hull portion that accommodates the water flow when operating in reverse thrust mode and which provides a continuous underlying panel when operating in the forward thrust mode.

A closure panel extension 39 (see also FIG. 4) is pivotally supported on the closure plate 22 adjacent the forward end of the cut-out 37 by means of a pivot pin 41. The closure panel 39 is formed with a tab that carries a connector 42 for connection to a further bowden wire actuator 43 for its operation. The bowden wire actuator 43 is also connected to the shift lever 35 so that when the shift lever 35 is moved to the reverse thrust position, the closure panel 39 will be shifted to a reverse thrust position as shown in FIGS. 2 and 4 wherein the water discharged downwardly past the reverse thrust bucket 33 can pass without obstruction. However, when driving in a forward drive mode, the panel 39 will close the opening 37 and provide good hull performance.

FIG. 3 shows another embodiment which is generally the same as the embodiment of FIGS. 1, 2 and 4. This embodiment differs from the previous embodiment only in the shape of the steering nozzle 29 and the manner in which the reverse thrust bucket 33 accomplishes the reverse thrust. In this embodiment, the steering nozzle has a discharge portion 101 that extends downwardly and forwardly in the area of the slot 37 and which is normally closed by the panel closure 39. When in the reverse thrust position, as shown in FIG. 3, the reverse thrust bucket 33 completely obscures the steering nozzle discharge 31 and all water is discharged through the discharge portion 101 through the slot 37, the panel 39 being opened automatically upon movement of the reverse thrust bucket 33 to its reverse thrust position, as aforedescribed.

It should be readily apparent from the foregoing description that the described embodiments of the invention are extremely effective in providing good hull performance when traveling in a forward mode and also obstructed water flow when operating in the reverse mode. Of course, the foregoing description is that of preferred embodiments of the invention and various changes and modifications may be made without departing from the spirit and scope of the invention, as defined by the appended claims.

I claim:

1. A watercraft having a hull and a jet propulsion unit supported by said hull for propelling said watercraft, said jet propulsion unit having a discharge nozzle, a reverse thrust bucket supported for movement relative to said discharge nozzle between a forward drive position and a reverse drive position wherein the water from the discharge nozzle is diverted in a forward direction so as to provide a reverse driving thrust, said hull having a portion underlying said discharge nozzle, and a movable closure plate carried directly by said underlying portion and moveable between a closed position to provide an extension of the hull that extends under said discharge nozzle and an open position to provide an opening through which the water diverted by said reverse thrust bucket may pass when operating in the reverse thrust mode.

2. A watercraft as set forth in claim 1 wherein the hull is provided with a tunnel at the rear end thereof and the jet propulsion unit is supported within the tunnel.

3. A watercraft as set forth in claim 2 wherein the hull portion is formed at least in part by a closure plate underlying the tunnel and extending beneath the discharge nozzle.

4. A watercraft as set forth in claim 3 wherein the reverse thrust bucket and the hull closure are operated simultaneously by a common actuator.

5. A watercraft as set forth in claim 4 wherein the closure and reverse thrust bucket are each operated by a respective wire actuator.

6. A watercraft as set forth in claim 5 wherein the closure is formed by a pivotally supported member pivotally supported at the forward end of the opening in the underlying hull portion.

7. A watercraft as set forth in claim 1 wherein the reverse thrust bucket and the hull closure are operated simultaneously by a common actuator.

8. A watercraft as set forth in claim 7 wherein the closure and reverse thrust bucket are each operated by a respective wire actuator.

9. A watercraft as set forth in claim 7 wherein the closure is formed by a pivotally supported member pivotally supported at the forward end of the opening in the underlying hull portion.

10. A watercraft as set forth in claim 9 wherein the closure and reverse thrust bucket are each operated by a respective wire actuator.

11. A watercraft as set forth in claim 1, wherein the hull underlying portion defines an opening opened and closed by the moveable closure plate, said opening being defined by a pair of side portions extending along the sides of said opening, said moveable closure plate being flush with said side portions when in its closed position.

12. A watercraft as set forth in claim 11, wherein the closure is formed by a pivotally supported member pivotally supported at the forward end of the opening in the underlying hull portion.

13. A watercraft as set forth in claim 11, wherein the reverse thrust bucket and the hull closure are operated simultaneously by a common actuator.

* * * * *